US007207500B2

(12) United States Patent
Hudson et al.

(10) Patent No.: US 7,207,500 B2
(45) Date of Patent: Apr. 24, 2007

(54) BATTERY-POWERED PUMP FOR LIQUID SPRAYER

(75) Inventors: William A. Hudson, Fox Point, WI (US); Robert C. Hudson, Jr., Northbrook, IL (US); Da Wei David Chen, Taiwan (TW)

(73) Assignee: H.D. Hudson Manufacturing Co., Chicago, IL (US)

( * ) Notice: Subject to any disclaimer, the term of this patent is extended or adjusted under 35 U.S.C. 154(b) by 153 days.

(21) Appl. No.: 10/964,312

(22) Filed: Oct. 13, 2004

(65) Prior Publication Data

US 2006/0076435 A1 Apr. 13, 2006

(51) Int. Cl.
*B05B 9/04* (2006.01)

(52) U.S. Cl. ..... 239/332; 239/373; 239/530; 239/532; 222/333

(58) Field of Classification Search ..... 239/332, 239/373, 525, 530, 532; 222/333
See application file for complete search history.

(56) References Cited

U.S. PATENT DOCUMENTS

| | | | | |
|---|---|---|---|---|
| 3,901,449 | A * | 8/1975 | Bochmann | 239/332 |
| 4,082,565 | A | 4/1978 | Sjölander | |
| 4,269,356 | A | 5/1981 | Rose | |
| 4,333,609 | A | 6/1982 | Backo | |
| 4,362,275 | A | 12/1982 | Coffee | |
| 4,408,720 | A | 10/1983 | Anderson et al. | |
| 4,618,099 | A * | 10/1986 | Nagao et al. | 239/332 |
| 4,651,903 | A | 3/1987 | Pagliai | |
| 4,790,454 | A * | 12/1988 | Clark et al. | 239/332 |
| 4,801,088 | A | 1/1989 | Baker | |
| 4,865,255 | A | 9/1989 | Luvisotto | |
| 4,881,687 | A | 11/1989 | Ballu | |
| 5,150,841 | A * | 9/1992 | Silvenis et al. | 239/332 |
| 5,421,900 | A | 6/1995 | Clontz | |
| 5,716,007 | A | 2/1998 | Nottingham et al. | |
| 5,752,661 | A | 5/1998 | Lewis | |
| 5,807,313 | A | 9/1998 | Delk et al. | |
| 6,109,548 | A | 8/2000 | George et al. | |
| 6,145,711 | A | 11/2000 | Prosper et al. | |
| 6,502,766 | B1 * | 1/2003 | Streutker et al. | 239/332 |
| 6,644,564 | B2 | 11/2003 | Perkitny | |
| 7,097,119 | B2 * | 8/2006 | Hornsby et al. | 222/333 |

OTHER PUBLICATIONS

Hudson Yard & Garden Sprayer, 1998 HDH Mfg. Co. 1 page.
Hudson Porta Spray Multi-Purpose Sprayer, 2001 HDH Mfg. 1 page.

* cited by examiner

*Primary Examiner*—Steven J. Ganey
(74) *Attorney, Agent, or Firm*—Marshall, Gerstein & Borun LLP

(57) ABSTRACT

A pump apparatus for a liquid sprayer is provided having a housing adapted to be releasably connected to a vessel containing liquid to be sprayed. The housing includes an upper portion and a lower portion releasably connected to the upper portion. The upper portion includes at least a pump and an electric motor for driving the pump. The lower portion includes at least a power supply for providing power to the motor.

36 Claims, 8 Drawing Sheets

BATTERY-POWERED PUMP FOR LIQUID SPRAYER

FIELD OF THE INVENTION

This application relates generally to an improved pumping apparatus and system, and more particularly, to a battery-operated pump for a liquid sprayer.

BACKGROUND OF THE INVENTION

Liquid sprayers have long been used to spray liquids of various types. Earlier sprayers included a tank equipped with a hand-operated pump, which would be used to supply the pressure necessary to deliver the liquid contained in a reservior in the tank to a hand-held wand (with attached spray nozzle) used for application of the liquid. A shortcoming associated with this type of spraying device is that considerable time and effort is required to manually operate the pump to maintain the appropriate pressure in the tank or related vessel for spraying.

More recent liquid sprayers include the use of a battery-powered pumping system. In these systems, the portable sprayer includes a pump operated by electrical power supplied by a rechargeable battery. The pump is typically housed in a pump unit or the like, which is inserted into the sprayer tank. The rechargeable batteries are also housed within the pump unit and supply the electrical power necessary to operate the pump.

In these battery-powered sprayer systems, a battery charger must be placed somewhere in the system to permit the batteries to be recharged when depleted. In the alternative, the sprayer can be plugged into an electrical outlet or other source of AC power when possible to prevent depletion of or as a back-up to the batteries. A shortcoming associated with these battery-powered pumping systems is that there is always the potential for a complete failure of the battery charge, which cannot be replaced without major repair to the system. In such a situation, the only other option may be to plug the device into an AC outlet. However, a user may not always be in a location where the use of such alternate AC power is feasible or available.

Accordingly, a need exists for a portable, battery-powered pump for a liquid sprayer that allows for more convenient replacement of the power supply prior to and during spraying operations.

SUMMARY OF THE INVENTION

To overcome these and other disadvantages associated with known liquid sprayers, a pump apparatus for a liquid sprayer is provided having a housing adapted to be releasably connected to a vessel containing liquid to be sprayed. The housing includes an upper portion and a lower portion releasably connected to the upper portion. The upper portion includes at least a pump and an electric motor for driving the pump. The lower portion includes at least a power supply for providing power to the motor.

The foregoing specific objects and advantages of the invention are illustrative of those that can be achieved by the present invention and are not intended to be exhaustive or limiting of the possible advantages which can be realized. Thus, these and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

BRIEF DESCRIPTION OF THE DRAWINGS

The accompanying figures best illustrate the details of the preferred pump apparatus and spraying system. Like reference numbers and designations in these figures refer to like elements.

DETAILED DESCRIPTION

Figure 1:
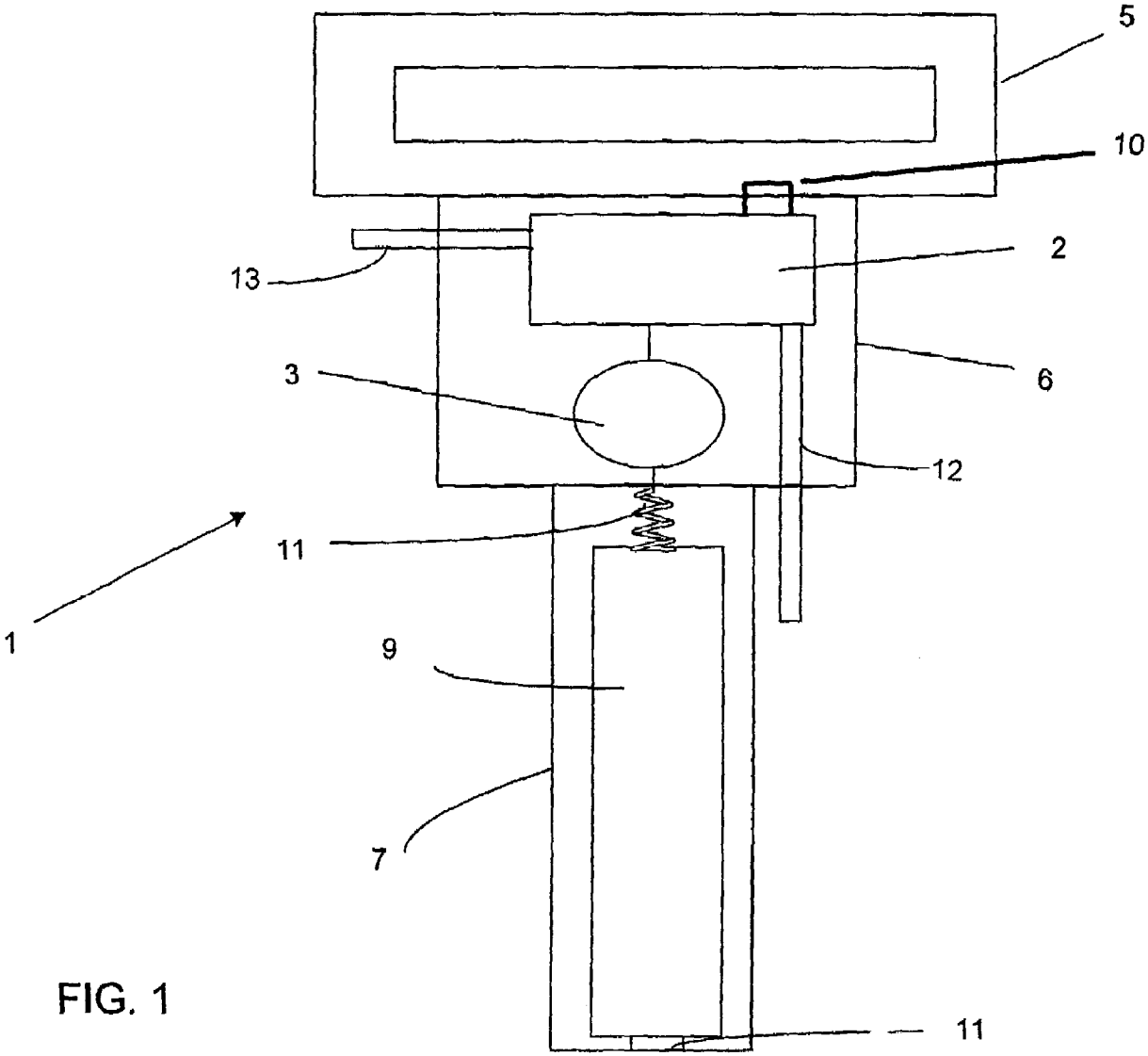
FIG. 1 illustrates a preferred embodiment of a pump apparatus.

FIG. 1 illustrates a pump apparatus 1 preferably used for a liquid sprayer in accordance with an embodiment of the present invention. The main components of the pump apparatus 1 include an upper pump portion 6 and a lower pump portion 7. The upper pump portion 6 preferably includes a pump 2, a motor 3 for driving the pump 2, handle 5, intake tube 12 and discharge tube 13. The lower pump portion 7 preferably includes a power supply 9 and at least one electrode 11 that contacts the power supply 9. The upper and lower pump portions 6, 7 are detachably connected to allow for easy access to the power supply 9. Therefore, if the power supply fails during a pumping operation, the user can quickly and easily replace the power supply 9.

The power supply 9 is preferably a rechargeable battery, one-time disposable battery or battery pack. It is contemplated that the power supply 9 is of sufficient voltage to adequately supply power to the internal electrical components of the pump apparatus 1. By way of example, the power supply 9 may be any size between 1 and 12 volts DC. It is understood, however, that the size of the power supply 9 is in no way limited to these sizes and may vary depending on the size and power requirements of the pump apparatus 1.

In a preferred embodiment, the power supply 9 selectively provides power to the internal components of the pump apparatus 1 when the user depresses or otherwise actuates an on/off switch 10 preferably located on the upper pump portion, which closes the circuit between the power supply 10 and the other electrical components of the apparatus 1. A more detailed description of the communication between the switch 10 and the electrical power circuit will be addressed in connection with the figures that follow.

Figure 2:
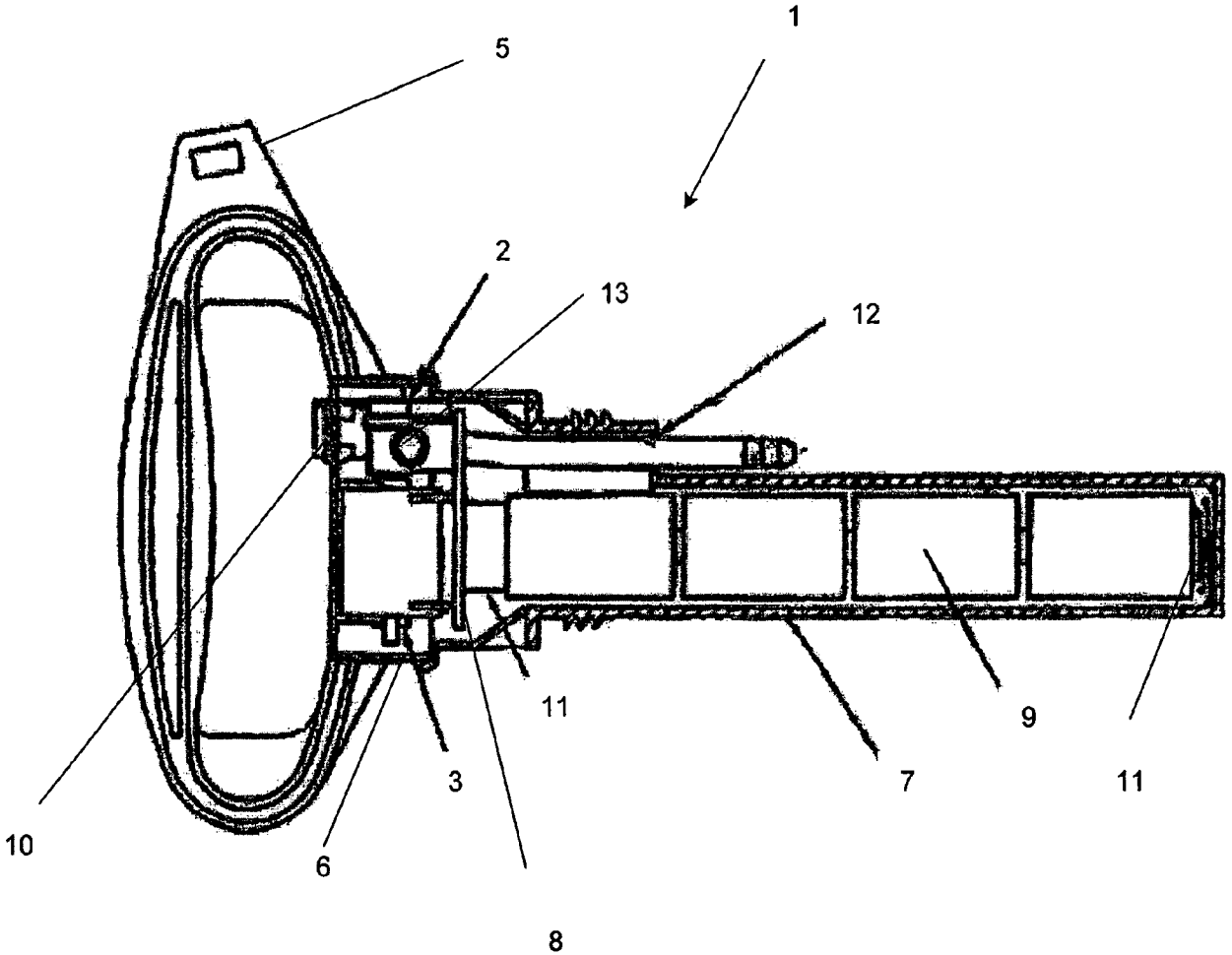
FIG. 2 illustrates another embodiment of the pump apparatus.

FIG. 2 illustrates another preferred embodiment of the pump apparatus 1. In contrast to the embodiment illustrated in FIG. 1, the pump 2 and motor 3 are shown in FIG. 2 to be positioned side-by-side and mounted on a common base plate 8 that separates the upper and lower pump portions 6, 7. It is understood that a conventional gear box or transmission (not shown) may be positioned between the pump and motor to, among other things, increase the torque output from the motor to the pump. FIG. 2 also illustrates in greater detail the power circuit used to supply power from the power supply 9 to the other electrical components in the pump apparatus 1, which includes the use of an on/off switch 10.

In FIG. 2, the pump 2 and motor 3 are mounted on the upper surface of the base plate 8. This side-by-side configuration allows for the upper pump portion 6 to be a more compact design for easier handling of the pump apparatus 1 during pumping operations. The bottom surface of the base plate 8 provides support for the upper electrode 11 as well as the intake tube 12. It is preferred that the intake tube 12 extends from the pump 2 and through or around the base plate 8 in a parallel orientation with respect to the power supply 9. Also extending from the pump 2 is the discharge tube 13, which is preferably oriented in a direction that is approximately at a right-angle with respect to the intake tube 12.

The power circuit in the apparatus 1 is preferably energized when the switch 10 is depressed, moved forward or otherwise actuated. Once the switch 10 is depressed or actuated, contacts (not shown) close the power circuit in the apparatus 1 so that the motor 3 receives power from the power supply 9 to drive the pump 2. Power is preferably removed from the power circuit when the switch 10 is released, moved backward or otherwise actuated to separate the contacts and, thereby, open the circuit.

Figure 3:
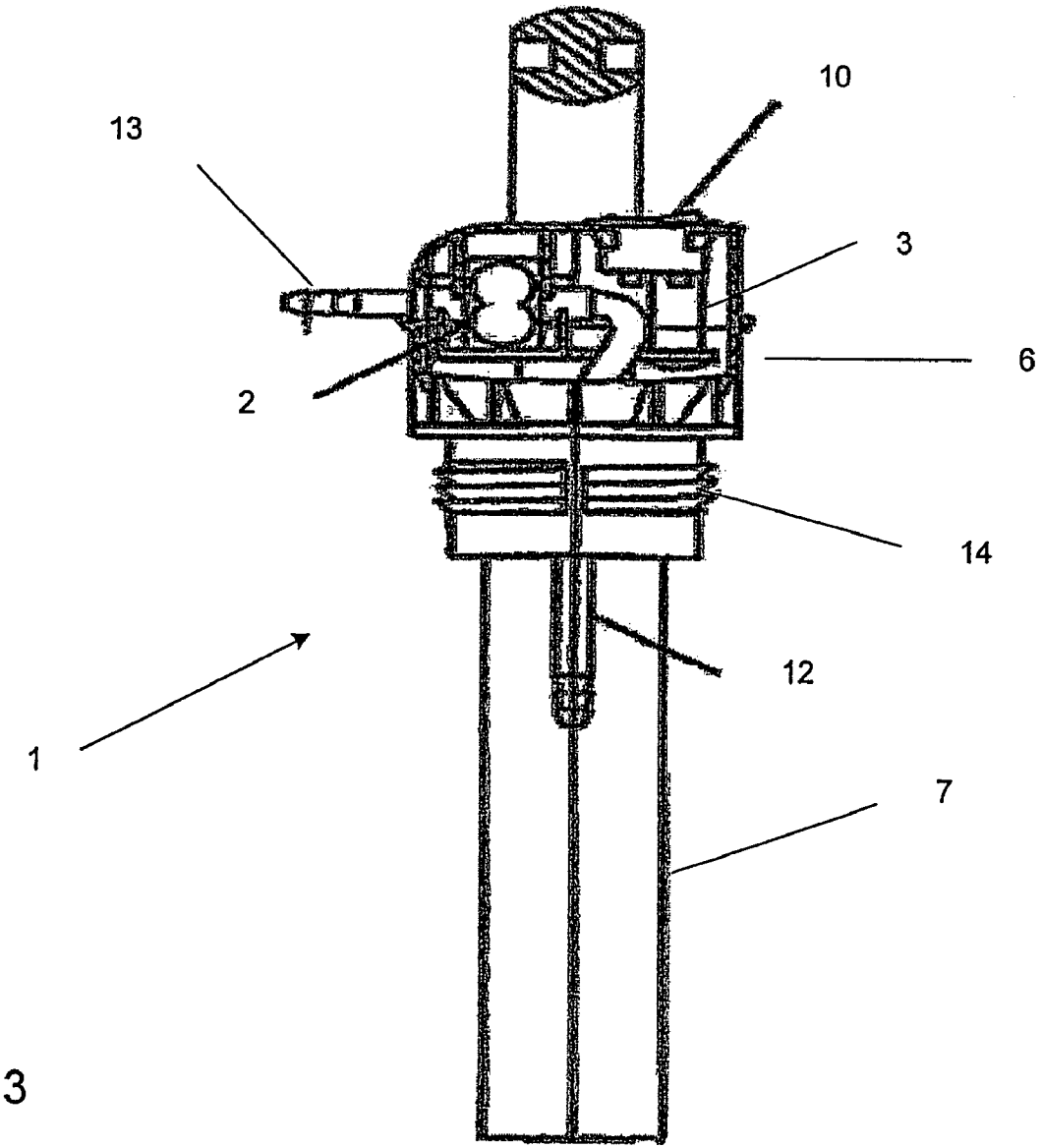
FIG. 3 is a side view of the pump apparatus illustrated in FIG. 2.

FIG. 3 is a side view of the preferred pump apparatus 1 shown in FIG. 2. Means for attaching the pump apparatus 1 to a corresponding tank or vessel 15 (not shown) is illustrated in FIG. 3. The attachment means 14 is preferably located on the upper pump portion 6 of the pump apparatus 1. As illustrated in FIG. 3, the attachment means 14 is preferably external threads formed about the perimeter of a lower section of the upper pump portion 6. The threads 14 are intended to engage in a male-to-female relationship with corresponding internal threads 18 formed within an opening in a vessel or tank 15 (FIG. 5) when using a twisting action to releasably secure the pump apparatus 1 to the vessel 15. A more detailed illustration of the preferred vessels 15 can be seen in FIGS. 5–8. It is understood that other conventional attachment means 14 can be utilized instead of mating threads to releasably attach the pump assembly 1 to a vessel 15, such as, for example, a twist and lock configuration, a flexible or spring-loaded snap or tab, a spring-loaded ball engaging a detent, or the like.

FIG. 3 also illustrates more clearly the preferred orientation of the discharge tube 13 with respect to the intake tube 12. As shown, the discharge tube 13 is preferably located in a direction that is approximately at a right angle to the intake tube 12. Both the intake and discharge tubes 12, 13 preferably extend from the pump 2 and beyond the upper pump portion 6. Although the intake tube 12 extends from the upper pump portion 6, it preferably remains within the circumference of the upper pump portion 6. For example, when the pump apparatus 1 is secured to the vessel or tank 15, the intake tube 12 will preferably extend beyond the upper pump portion 6 and into the vessel 15.

Figure 4:
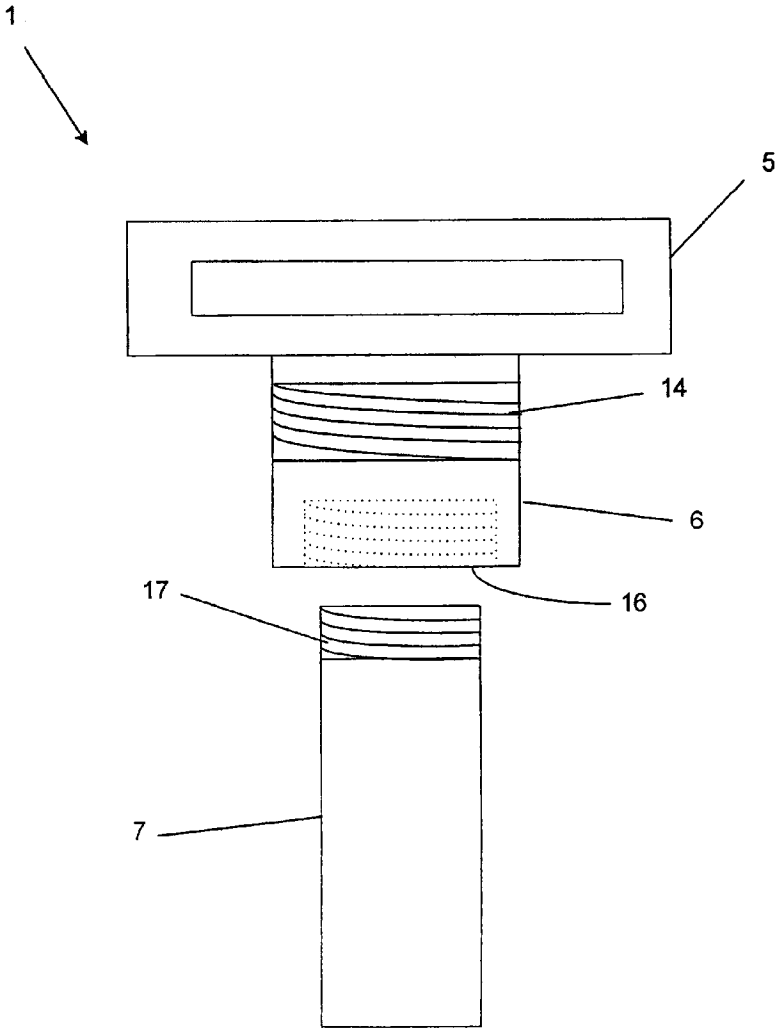
FIG. 4 is an exploded view of the pump apparatus illustrating a preferred mode for releasably connecting upper and lower portions of the pump apparatus.

Referring to FIG. 4, the upper pump portion 6 of the pump apparatus 1 is preferably releasably connected to the lower pump portion 7. The upper pump portion 6 preferably has two attachment means 14, 16—a first attachment means 14 (discussed above) on the perimeter of the upper pump portion 6 for releasably securing the pump apparatus 1 to the vessel 15, and a second attachment means 16, 17 for releasably securing the upper pump portion 6 to the lower pump portion 7.

The second attachment means is preferably a pair of mating threads 16, 17 formed on the upper and lower portions 6, 7. As shown in FIG. 4, the upper pump portion 6 preferably includes an internally threaded opening 16 for receiving in male-to-female relationship an end of the lower pump portion 7. External threads 17 formed around the periphery of the end of the lower pump portion 7 preferably engage the corresponding internal threads 16 formed on the upper pump portion 7 to releasably connect the upper and lower pump portions.

Although FIG. 4 illustrates the upper pump portion 6 as having internal threads 16 and the lower pump portion 7 as having mating external threads 17, it is understood that the lower pump portion could alternatively include an internally threaded opening for receiving in a male-to-female relationship external threads formed on the upper pump portion. It is also understood that other conventional attachment means 14 can be utilized instead of mating threads to releasably attach the upper pump portion 6 to the lower pump portion 7, such as, for example, a twist and lock configuration, a flexible or spring-loaded snap or tab, a spring-loaded ball engaging a detent, or the like.

Figure 5:
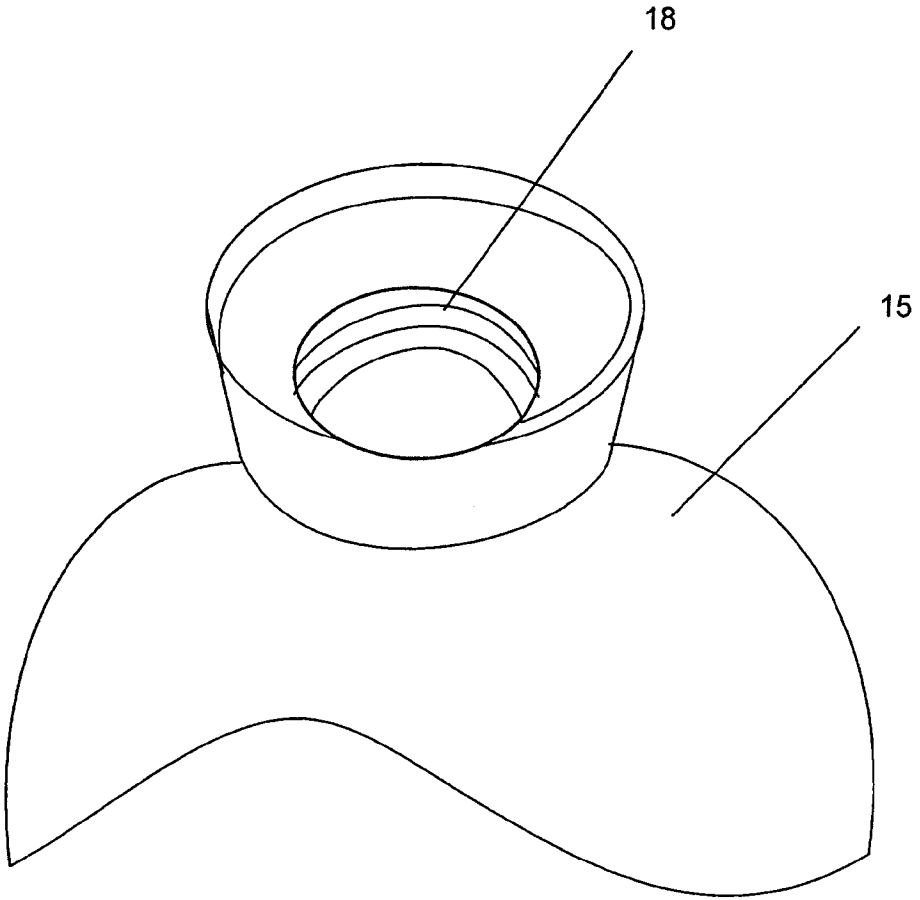
FIG. 5 illustrates the top of a preferred vessel for attaching the pump apparatus.

FIG. 5 illustrates a vessel or tank 15 to which the pump assembly 1 may be attached. The vessel 15 is intended to serve as a reservior for the liquid to be dispensed by the sprayer. The vessel 15 preferably includes an opening 18 into the interior of the vessel, which as discussed above is preferably internally threaded for mating engagement to corresponding threads 14 formed on the upper pump portion 6 to releasably connecting the pump assembly 1 to the vessel 15.

Figure 6:
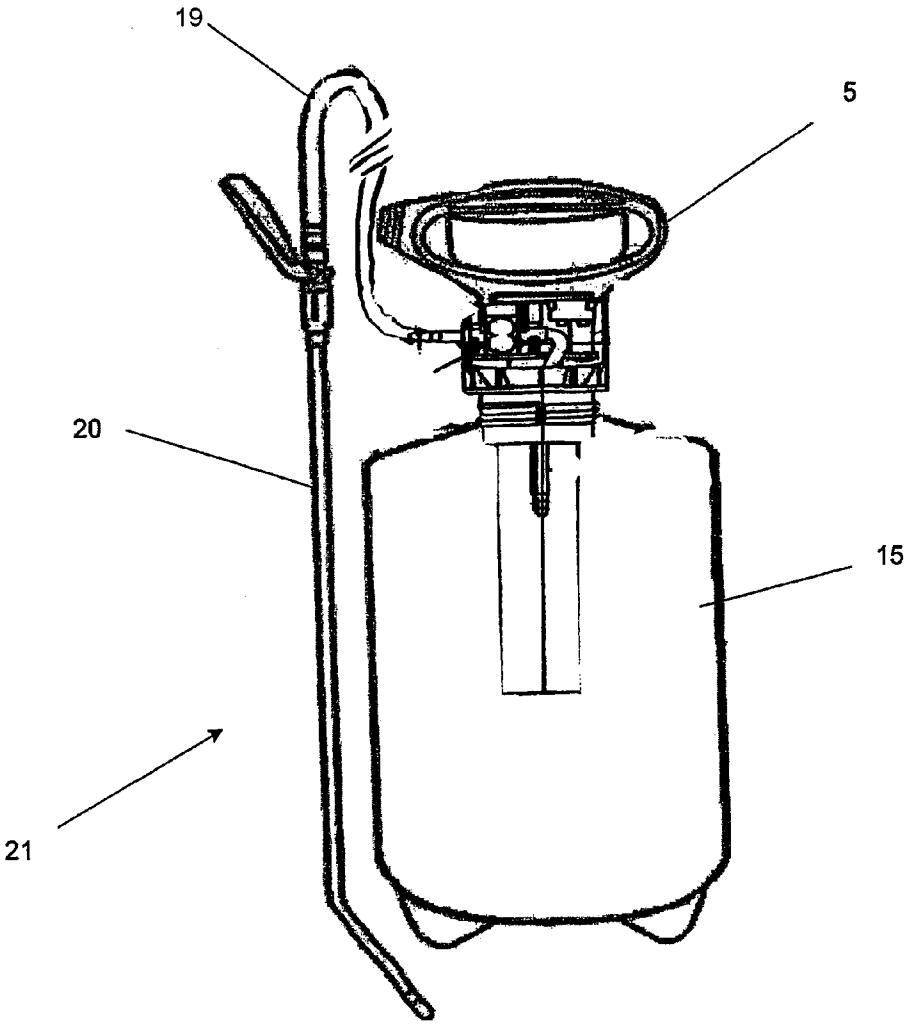
FIG. 6 illustrates a preferred embodiment of the liquid sprayer system, including a preferred pump apparatus, discharge device, and liquid reservoir or vessel.

FIG. 6 illustrates a preferred pump or sprayer system 21 that includes two main components—the pump apparatus 1 and the vessel 15. The basic components of the pump apparatus 1 are the same as that already discussed above in connection with FIGS. 2–4.

Referring to FIG. 6, the preferred system 21 also includes a discharge hose 19 that extends from and fluidly connects the pump discharge tube 13 to a discharge device 20. The discharge device 20 can be a spray wand or the like for controlling and directing the discharge of liquid from the system. The spray wand may include a conventional nozzle for providing a fixed and/or variable spray pattern. The discharge hose 19 is preferably a flexible hose or tubing, but can also be a rigid tube or pipe. The discharge hose 19 is preferably connected to the discharge tube 13 in a conventional manner.

In the preferred embodiment, one end of an intake hose (not shown) is fluidly connected to and extends from the intake tube 12 of the pump apparatus 1. The other end of the intake hose extends into the interior of and below the level of liquid contained in the vessel 15 to liquid to be drawn through the intake hose by suction generated by the pump 2. The intake hose is preferably a flexible hose, but can also be a rigid tube or pipe. The intake hose is preferably connected to the intake tube 12 in a conventional manner and may be free standing in the liquid contained within the vessel 15.

The vessel 15 is preferably portable, and its size/volume and shape will vary depending on the desired pumping operation and user performance. By way of example, the vessel 15 may be a single gallon container or a container large enough to hold several gallons. Also by way of example, it is contemplated that the vessel may be used for water or other liquids. However, the pump system 21 is in no way limited to only these types of liquids. The type of liquid used will vary depending on the pumping operation and desired results.

Figure 7:
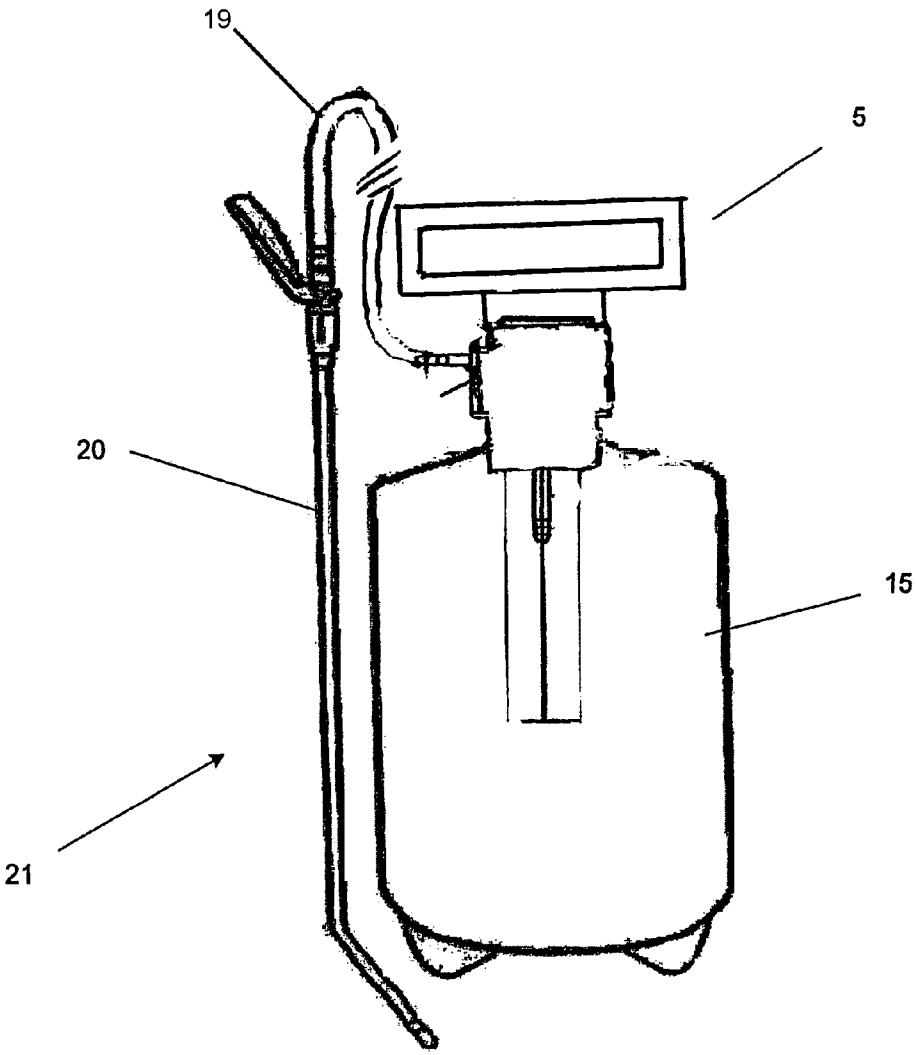
FIG. 7 illustrates another embodiment of the liquid sprayer system.
Figure 8:
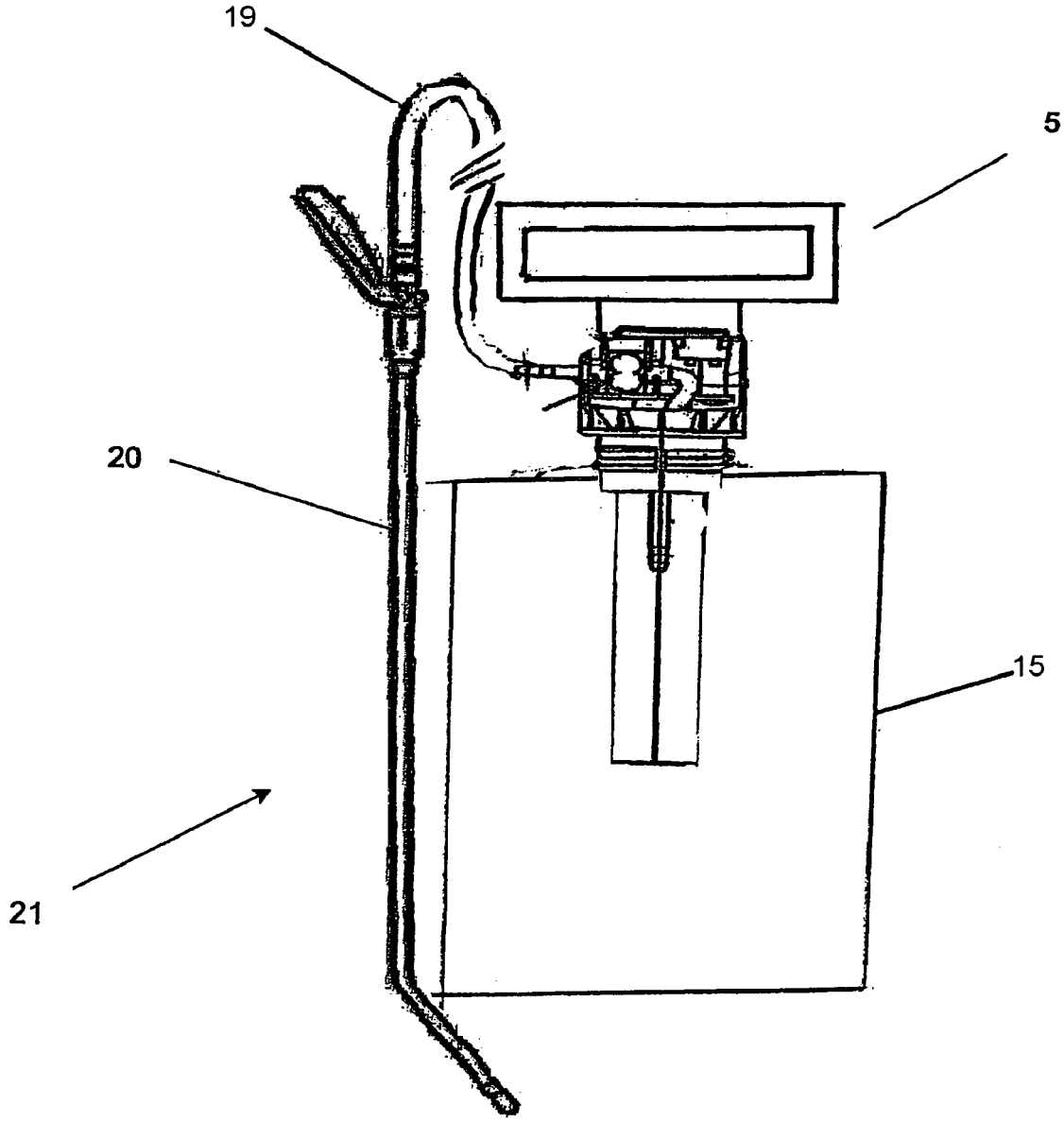
FIG. 8 illustrates another embodiment of the liquid sprayer system.

FIGS. 7 and 8 illustrate alternative pump or spray systems 21 similar to that illustrated in FIG. 6. The notable difference between the systems illustrated in FIGS. 6 and 7 is the size and shape of the handle 5. The notable difference between the systems illustrated in FIGS. 6 and 8 is shape of the handle 5 and vessel 15.

Although illustrative embodiments have been described herein in detail, its should be noted and understood that the descriptions and drawings have been provided for purposes of illustration only and that other variations both in form and detail can be added thereupon without departing from the spirit and scope of the invention. The terms and expressions have been used as terms of description and not terms of limitation. There is no limitation to use the terms or expressions to exclude any equivalents of features shown and described or portions thereof.

We claim:

1. A liquid sprayer comprising a vessel having a reservoir for holding liquid to be sprayed and a pump unit releasably connected to the vessel, the pump unit comprising:

a housing with an upper portion and a lower portion releasably connected to the upper portion;

a pump mounted to part of the upper housing portion;

an electric motor mounted to part of the upper housing portion; and a power supply that is disposed in the lower portion and is connected to provide power to the motor.

2. The liquid sprayer of claim 1, further comprising means for releasably connecting the upper portion of the housing to the lower portion.

3. The liquid sprayer of claim 1, further comprising means for releasably connecting the housing to the vessel.

4. The liquid sprayer of claim 1, wherein the vessel includes an internally threaded opening for engaging corresponding threads formed on at least part of the housing to releasably connect the housing to the vessel.

5. The liquid sprayer of claim 1, wherein the power supply includes at least one battery.

6. The liquid sprayer of claim 5, wherein the at least one battery is rechargeable.

7. The liquid sprayer of claim 5, wherein the at least one battery is a single use battery.

8. The liquid sprayer of claim 1, further comprising a switch for selectively providing power to the motor.

9. The liquid sprayer of claim 1, further comprising a handle connected to the upper portion of the housing.

10. The liquid sprayer of claim 1, further comprising an intake tube having a proximal end and a distal end, the proximal end of the intake tube connected to and in fluid communication with an intake port on the pump, and the distal end of the intake tube extending into the reservoir in the vessel.

11. The liquid sprayer of claim 1, further comprising a discharge tube having a proximal end and a distal end, the proximal end of the discharge tube connected to and in fluid communication with a discharge port on the pump.

12. The liquid sprayer of claim 11, further comprising a spray nozzle in fluid communication with the discharge tube.

13. The liquid sprayer of claim 11, further comprising a discharge device connected to and in fluid communication with the distal end of the discharge tube.

14. The liquid sprayer of claim 13, wherein the discharge device includes a spray nozzle.

15. The liquid sprayer of claim 13, wherein the discharge device is a spray wand.

16. The liquid sprayer of claim 15, wherein the discharge device includes a valve for controlling the discharge of liquid through the spray wand.

17. A liquid sprayer comprising a vessel having a reservoir for holding liquid to be sprayed and a pump unit releasably connected to the vessel, the pump unit comprising:

a housing with an upper portion and a lower portion that is releasably connected to the upper portion;

a base plate that is disposed within the upper portion of the housing and has a top surface and a bottom surface;

a pump that is mounted on the top surface of the base plate and is disposed in the upper housing portion;

an electric motor that is mounted on the top surface of the base plate and is disposed in the upper housing portion; and a power supply that is disposed in the lower housing portion proximal to the bottom surface of the base plate and is connected to provide power to the motor.

18. The liquid sprayer of claim 17, wherein the pump and motor are mounted on the base plate in a side-by-side configuration.

19. A liquid sprayer comprising a vessel having a reservoir for holding liquid to be sprayed and a pump unit releasably connected to the vessel, the pump unit comprising:

a housing with an upper portion and a lower portion that is releasably connected to the upper portion;

an internally threaded opening on the upper housing portion and corresponding threads formed on at least part of the lower portion of the housing that together enable the lower housing portion to be releasably connected to the upper housing portion;

a pump that is disposed in the upper housing portion;

an electric motor that is disposed in the upper housing portion; and a power supply that is disposed in the lower housing portion and is connected to provide power to the motor.

20. A liquid sprayer comprising a vessel having a reservoir for holding liquid to be sprayed and a pump unit releasably connected to the vessel, the pump unit comprising:

a housing with an upper portion and a lower portion that is releasably connected to the upper portion;

a pump that is disposed in the upper housing portion;

an electric motor that is disposed in the upper housing portion;

a switch that is located on the upper housing portion and is connected to selectively provide power to the motor; and a power supply that is disposed in the lower housing portion and is connected to provide power to the motor.

21. A liquid sprayer comprising a vessel having a reservoir for holding liquid to be sprayed and a pump unit releasably connected to the vessel, the pump unit comprising:

a housing with an upper portion and a lower portion that is releasably connected to the upper portion;

a handle that is connected to and integral with the upper housing portion;

a pump that is disposed in the upper housing portion;

an electric motor that is disposed in the upper housing portion; and a power supply that is disposed in the lower housing portion and is connected to provide power to the motor.

22. A liquid sprayer comprising a vessel having a reservoir for holding liquid to be sprayed and a pump unit releasably connected to the vessel, the pump unit comprising:

a housing with an upper portion and a lower portion that is releasably connected to the upper portion;

a pump that is disposed in the upper housing portion;

an intake tube that extends from an intake port on the pump, through a base plate, substantially parallel to a longitudinal axis of the lower portion of the housing, into the reservoir in the vessel;

an electric motor that is disposed in the upper housing portion; and a power supply that is disposed in the lower housing portion and is connected to provide power to the motor.

23. A pump apparatus for a liquid sprayer, that has:

a housing that is adapted to be releasably connected to a vessel containing liquid to be sprayed, and has an upper housing portion and a lower housing portion that is releasably connected to the upper housing portion;

a pump that is mounted to part of the upper housing portion;

an electric motor that is mounted to part of the upper housing portion and is connected to drive the pump; and a power supply that is disposed in the lower housing portion and is connected to provide power to the motor.

24. The pump apparatus of claim 23, further comprising means for releasably connecting the upper portion of the housing to the lower portion.

25. The pump apparatus of claim 23, further comprising means for releasably connecting the housing to the vessel.

26. The pump apparatus of claim 23, wherein at least part of the housing includes threads adapted to engage corresponding threads on the vessel to releasably connect the housing to the vessel.

27. The pump apparatus of claim 23, wherein the power supply includes at least one battery.

28. The pump apparatus of claim 27, wherein the at least one battery is rechargeable.

29. The pump apparatus of claim 27, wherein the at least one battery is a single use battery.

30. The pump apparatus of claim 23, further comprising a switch for selectively providing power to the motor.

31. The pump apparatus of claim 23, further comprising a handle connected to the upper portion of the housing.

32. The A pump apparatus for a liquid sprayer, that has:

a housing that is adapted to be releasably connected to a vessel containing liquid to be sprayed, and has an upper housing portion and a lower housing portion that is releasably connected to the upper housing portion;

a base plate that is disposed within the upper portion of the housing and has a top surface and a bottom surface;

a pump that is mounted on the top surface of the base plate, is disposed in the upper housing portion, and is connected to drive the pump;

an electric motor that is mounted on the top surface of the base plate and is disposed in the upper housing portion; and a power supply that is disposed in the lower housing portion proximal to the bottom surface of the base plate and is connected to provide power to the motor.

33. The pump apparatus of claim 32, wherein the pump and motor are mounted on the base plate in a side-by-side configuration.

34. A pump apparatus for a liquid sprayer, that has:

a housing that is adapted to be releasably connected to a vessel containing liquid to be sprayed, and has an upper housing portion and a lower housing portion that is releasably connected to the upper housing portion;

an internally threaded opening on the upper housing portion and corresponding threads formed on at least part of the lower portion of the housing that together enable the lower housing portion to be releasably connected to the upper housing portion;

a pump that is disposed in the upper housing portion;

an electric motor that is disposed in the upper housing portion and is connected to drive the pump; and a power supply that is disposed in the lower housing portion and is connected to provide power to the motor.

35. The A pump apparatus for a liquid sprayer that has:

a housing that is adapted to be releasably connected to a vessel containing liquid to be sprayed, and has an upper housing portion and a lower housing portion that is releasably connected to the upper housing portion;

a pump that is disposed in the upper housing portion;

a switch that is located on the upper housing portion and is connected to selectively provide power to the motor; and an electric motor that is disposed in the upper housing portion and is connected to drive the pump; and a power supply that is disposed in the lower housing portion and is connected to provide power to the motor.

36. A pump apparatus for a liquid sprayer, that has:

a housing that is adapted to be releasably connected to a vessel containing liquid to be sprayed, and has an upper housing portion and a lower housing portion that is releasably connected to the upper housing portion;

a pump that is disposed in the upper housing portion;

a handle that is connected to and integral with the upper housing portion;

an electric motor that is disposed in the upper housing portion and is connected to drive the pump; and a power supply that is disposed in the lower housing portion and is connected to provide power to the motor.

* * * * *

UNITED STATES PATENT AND TRADEMARK OFFICE

CERTIFICATE OF CORRECTION

PATENT NO. : 7,207,500 B2
APPLICATION NO. : 10/964312
DATED : April 24, 2007
INVENTOR(S) : Hudson et al.

It is certified that error appears in the above-identified patent and that said Letters Patent is hereby corrected as shown below:

At Column 7, line 47, “The A pump” should be -- A pump --.

At Column 8, line 27, “The A pump” should be -- A pump --.

Signed and Sealed this

Thirteenth Day of November, 2007

JON W. DUDAS
*Director of the United States Patent and Trademark Office*